US011326854B2

(12) United States Patent
Yollu

(10) Patent No.: US 11,326,854 B2
(45) Date of Patent: May 10, 2022

(54) MODULAR GRENADE LAUNCHER ASSEMBLY

(71) Applicants: ATA SILAH SANAYI ANONIM SIRKETI, Istanbul (TR); ARMSAN SILAH SANAYI VE TICARET ANONIM SIRKETI, Istanbul (TR)

(72) Inventor: Fatih Yollu, Istanbul (TR)

( * ) Notice: Subject to any disclaimer, the term of this patent is extended or adjusted under 35 U.S.C. 154(b) by 0 days.

(21) Appl. No.: 17/049,509

(22) PCT Filed: Dec. 25, 2018

(86) PCT No.: PCT/TR2018/050882
§ 371 (c)(1),
(2) Date: Oct. 21, 2020

(87) PCT Pub. No.: WO2019/245494
PCT Pub. Date: Dec. 26, 2019

(65) Prior Publication Data

US 2021/0364249 A1 Nov. 25, 2021

(30) Foreign Application Priority Data

Jun. 18, 2018 (TR) ..... 2018/08565

(51) Int. Cl.
*F41C 27/06* (2006.01)

(52) U.S. Cl.
CPC ..... *F41C 27/06* (2013.01)

(58) Field of Classification Search
CPC ..... F42C 27/06
USPC ..... 42/105
See application file for complete search history.

(56) References Cited

U.S. PATENT DOCUMENTS

| | | | | |
|---|---|---|---|---|
| 10,119,781 | B1 * | 11/2018 | Teetzel | F41C 27/06 |
| 2005/0132628 | A1 * | 6/2005 | Olson | F41C 27/06 42/105 |
| 2007/0068057 | A1 | 3/2007 | Macaluso | |
| 2007/0074437 | A1 * | 4/2007 | Compton | F41C 27/06 42/12 |
| 2012/0159829 | A1 | 6/2012 | Krutil et al. | |
| 2016/0153744 | A1 * | 6/2016 | Teetzel | F41A 19/10 42/105 |
| 2020/0284549 | A1 * | 9/2020 | Teetzel | F41A 19/10 |

FOREIGN PATENT DOCUMENTS

| | | | | |
|---|---|---|---|---|
| WO | 2014149003 | A1 | 9/2014 | |
| WO | WO-2014149003 | A1 * | 9/2014 | F41A 9/45 |
| WO | 2016089863 | A2 | 6/2016 | |

OTHER PUBLICATIONS

International Search Report for corresponding PCT/TR2018/050882 dated Dec. 26, 2019.
Written Opinion of the International Searching Authority for corresponding PCT/TR2018/050882 dated Dec. 26, 2019.

* cited by examiner

*Primary Examiner* — Bret Hayes
(74) *Attorney, Agent, or Firm* — Egbert, McDaniel & Swartz, PLLC

(57) ABSTRACT

A modular grenade launcher assembly which uses a 40×46 and 40×51 mm ammunition grenade launcher and which can be used with a portable rifle butt or can be mounted under a rifle.

7 Claims, 3 Drawing Sheets

MODULAR GRENADE LAUNCHER ASSEMBLY

TECHNICAL FIELD

The invention relates to a modular grenade launcher assembly which use of a 40×46 and 40×51 mm ammunition grenade launcher and which can be used with a portable rifle butt or can be mounted under a rifle.

BACKGROUND OF THE INVENTION

Today, weapons used in the defense industry to throw bombs are called grenade launchers. The reason for the use of grenade launchers is that they can throw the bomb away more quickly and more accurately than the manual shot.

The grenade launchers, usually mounted under the rifles, are now being designed on 2 different models with different application connections.

Today, weapons used in the defense industry to throw bombs are called bombs. The reason for the use of bomb beats is that they can throw the bomb away more quickly and more accurately than the manual shot.

The grenade launchers, usually mounted under the rifles, are now being designed on 2 different models with different application connections.

The first method is based on the working principle of opening and unloading of the barrel with one joint connection.

The second method allows the filling and unloading of both the right and left sides with the forward movement of the barrel.

In the case of unilateral opening, it is seen that the said grenade launchers do not provide convenience to each user.

The grenade launcher model, which opens the right and left of the barrel with the forward movement of the barrel, makes it difficult to use if the user extends forward under the infantry rifle.

The ammunition filling and unloading process cannot be done as fast as required in both models.

In the system which allows to open left and right with said forward motion, the barrel moves when the shot is made and prevents the shooting to be made as desired.

In the PCT application WO2016/089863 in the literature, relates to a modular grenade launcher system includes an upper chassis and subframe connected to opposite sides of a gun barrel, such as a firearm. This chassis is mounted so that any of the many interchangeable modules, including bomb calendars with different calibers, are removed. A separate, modular and removable firing mechanism is provided, wherein a plurality of bomb disposal devices can share a common firing mechanism. An auxiliary rail module is provided to replace the bomb-throwing barrel assembly and the firing mechanism.

In the aforementioned application, a modular grenade launcher system comprising a trigger device and a barrel assembly is disclosed.

In the European Patent application EP2478322B1 in the literature, relates to a barreled firearm which allows to change the direction of lying of the barrel and includes a rear block for fixing the barrel, the rear block includes a locking surface on a portion of its circumference and thus locking the firearm The surface is fixed against lying in the opposite direction of the surface. In order to change the direction of rotation of the barrel, the locking surface may be rotatable about the longitudinal axis of the rear block.

In the aforementioned application, a firearm structure with a lying barrel is described.

Due to the aforementioned disadvantages, a new modular grenade launcher was required.

DISCLOSURE OF THE INVENTION

The object of the invention is to provide a new modular grenade launcher which eliminates the disadvantages of the present invention.

Another object of the invention is to provide a structure that allows the filling and unloading of ammunition on both sides of the barrel without pushing the barrel forward.

Another object of the invention is to provide a structure that allows for faster filling and unloading of ammunition.

Another object of the invention is to provide a structure that prevents the barrel from moving during the shot.

It is a further object of the invention to provide a safer construction since the barrel is not fully closed without firing.

Another object of the invention is to provide a structure which does not constitute an obstacle in its assembled use under the infantry rifle since the trigger group is positioned towards the barrel center axis at maximum level.

REFERENCE NUMBERS

A—Modular Grenade Launcher Assembly
1. Handle
2. Polymer Body
3. Barrel
4. Barrel Mouth Thrust
5. Barrel Lock Button
6. Barrel Joint
7. Barrel Joint
8. Barrel Joint Channels
9. Handle Metal Sheet
10. Handle Channels
11. Handle Channels
12. Body Channels
13. Barrel Lock
14. Barrel Channels
15. Striker Security
16. Striker
17. Striker Support
18. Trigger
19. Pin
20. Trigger Security
21. Striker Safety Catch
22. Pin Tray
23. Bullet Tray
24. Trigger Joint

DETAILED DESCRIPTION OF THE INVENTION

In this detailed description, the invention is described with examples that will not have any limiting effect for better understanding of the subject matter.

The invention relates to a modular grenade launcher (A) provides for the use of ammunition bombs, with the use of portable rifles, or to be mounted under the infantry rifle and which is comprising at least one barrel (3) and enabling the filling and unloading of ammunition on both sides of said barrel (3) without moving forward characterized in that; comprise a handle (1) which is opening axially to both the right and left sides after contacting the barrel mouth thrust (4) located at the tip of said barrel (3).

Figure 1:
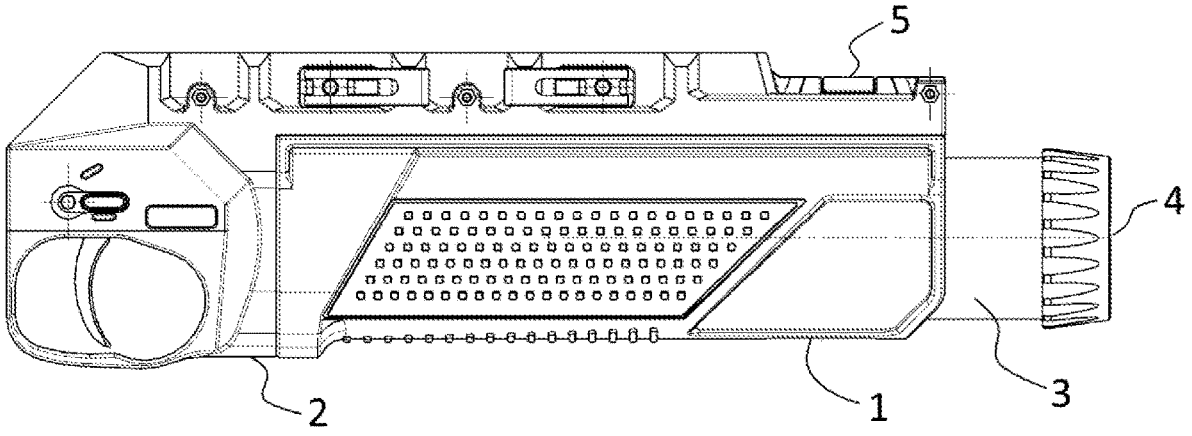
FIG. 1 is a side view of the modular grenade launcher assembly according to the invention.

FIG. 1 shows a side view of the modular grenade launcher assembly (A) according to the invention.

Figure 2:
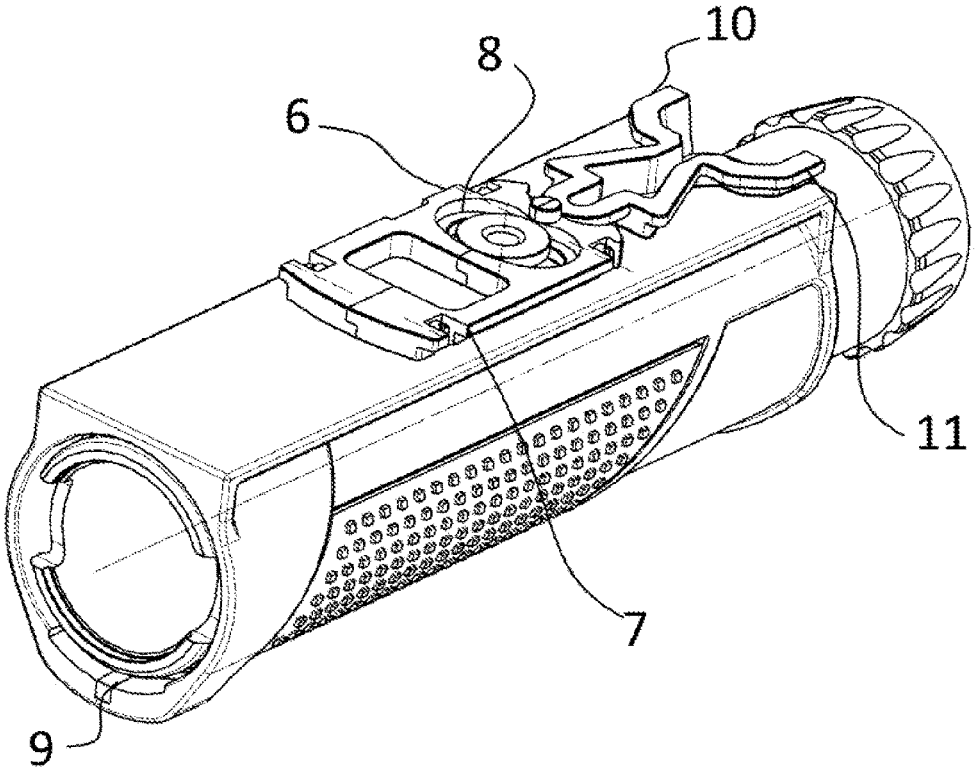
FIG. 2 is a perspective view of a modular grenade launcher assembly according to the invention.

FIG. 2 shows a perspective view of a modular grenade launcher assembly (A) according to the invention.

Figure 3:
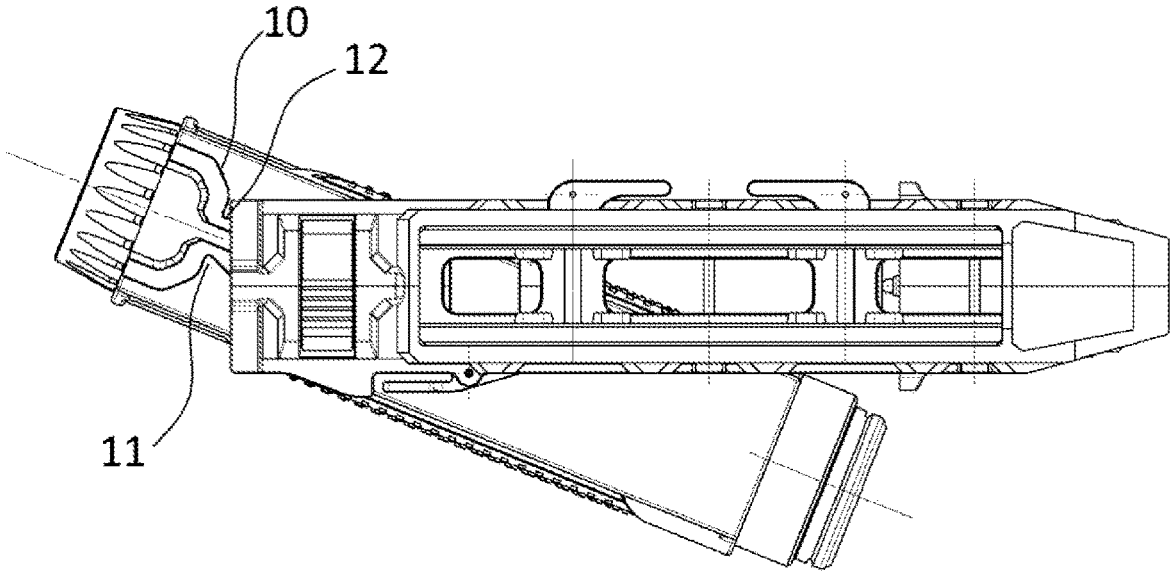
FIG. 3 is a top view of the modular grenade launcher assembly according to the invention.

FIG. 3 shows a top view of the modular grenade launcher assembly (A) according to the invention.

Figure 4:
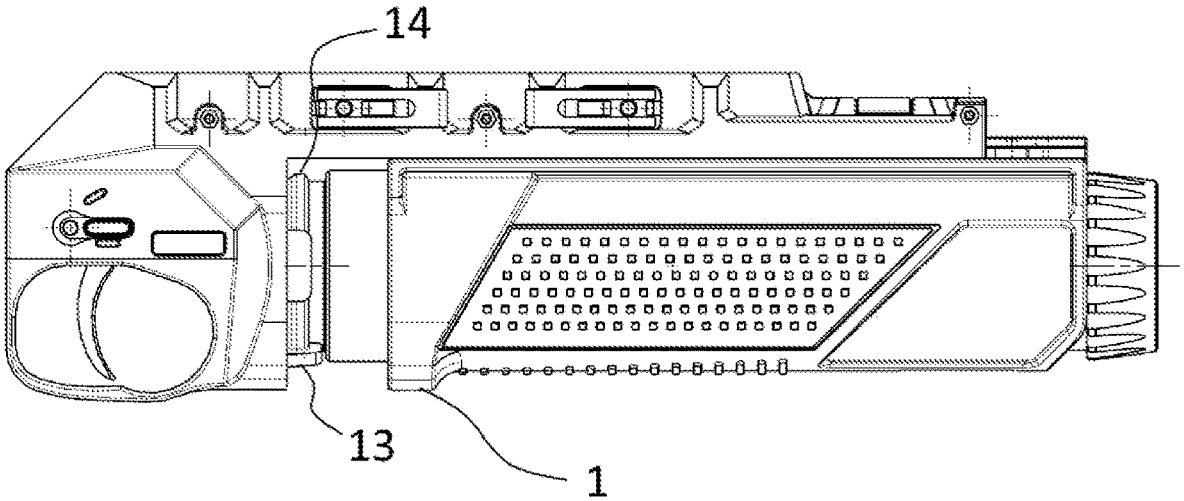
FIG. 4 is a side view of a modular grenade launcher assembly according to the invention.

FIG. 4 shows a side view of a modular grenade launcher assembly (A) according to the invention.

Figure 5:
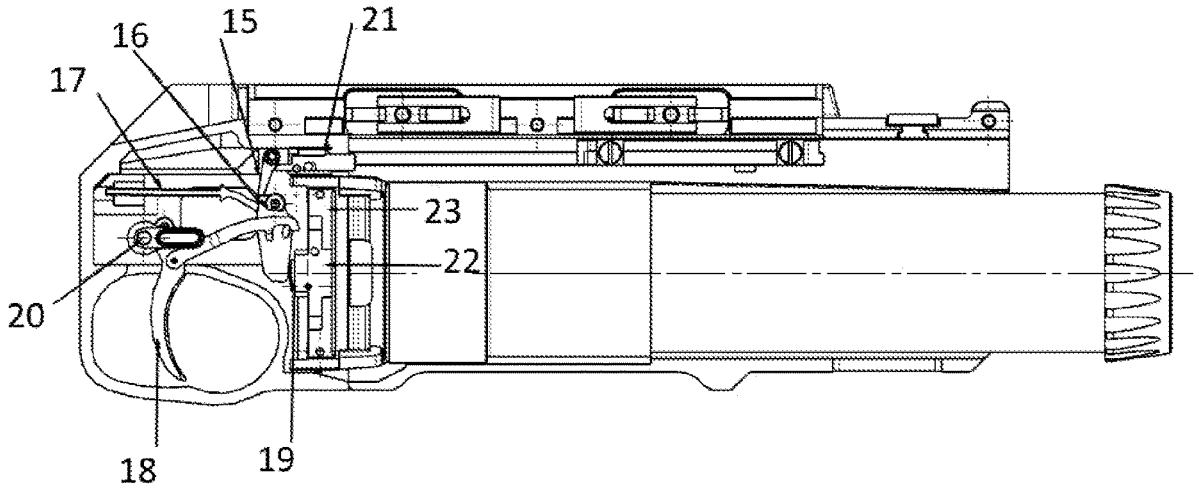
FIG. 5 is a side view of the modular grenade launcher assembly according to the invention.

FIG. 5 shows a side view of the modular grenade launcher assembly (A) according to the invention.

Figure 6:
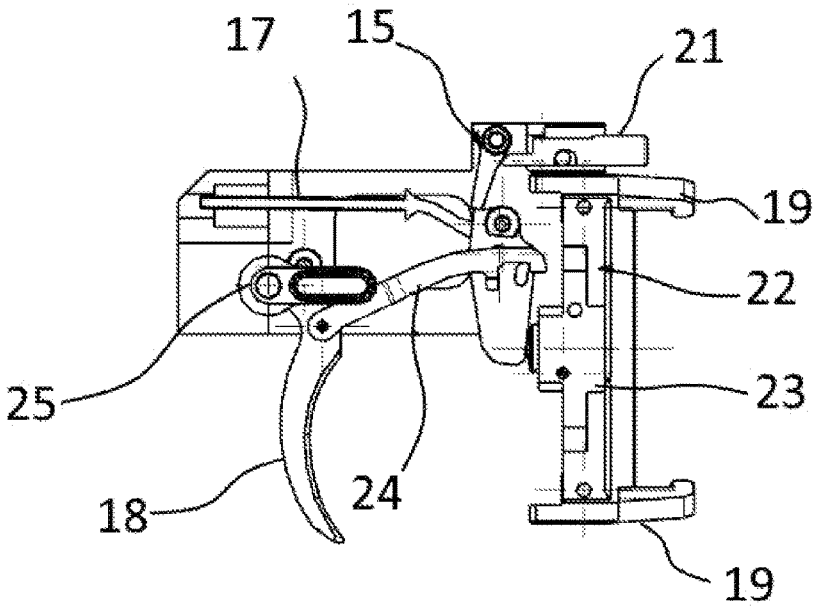
FIG. 6 is a side detail view of the modular grenade launcher assembly according to the invention.

FIG. 6 shows a side detail view of the modular grenade launcher assembly (A) according to the invention.

The modular grenade launcher assembly (A) according to the invention; consists of main parts that, handle (1), polymer body (2), barrel (3), barrel mouth thrust (4), barrel lock button (5), barrel joint (6,7), barrel joint channel (8), handle metal sheet (9), handle channels (10,11), body channels (12), barrel lock (13), barrel channels (14), striker security (15), striker (16), striker support (17), trigger (18), pin (19), trigger security (20), striker security catch (21), pin tray (22), bullet tray (23), trigger joint (24).

In the operation of said modular grenade launcher (A) in the operating system, when the handle (1) with the polymer body (2), the barrel (3) and the barrel mouth thrust (4); while the barrel (3) is in the fixed position, the handle (1) moves a certain distance by making a linear movement. In this movement, the handle (1) opens axially by turning to the right and left sides after contact with the barrel mouth thrust (4).

Said handle (1) moves linearly until the barrel lock button (5) touches the barrel joint (6,7). The handle (1) is provided to open or close the barrel joint channels (8).

The handle (1) is fixed to the barrel (3) by means of a handle metal sheet (9) which ensures that the barrel (3) does not rotate axially in the handle (1).

Said handle (1) moves with the handle channels (10, 11) on the barrel joint (6,7) and the handle (1).

When said barrel (3) rotates axially, the body channels (12) contact the handle channels (10,11). This prevents the overload of the barrel joints (6, 7).

In the case that said barrel (3) is axially parallel, the double barrel lock (13) sits in the barrel channels (14). Said double barrel lock (13) is fixed by movement of the handle (1).

When the said handle (1) is closed, it moves the striker security catch (21). This action allows the striker security (15) to be fired from the front of the striker (16). It is not possible to pull the trigger (18), especially when the barrel (3) is not closed.

The said trigger (18) can be pulled to help the striker (16) to return to a certain distance by means of the trigger joint (24). When the trigger joint (24) is freed from the striker (16), the striker support (17) helps the striker (16) with the help of a spring to hit the pin (19).

After this movement, ammunition can be detonated. It is based on the trigger security (20) when the trigger (18) is retracted to its maximum level. It is not possible for the trigger (18) to move when the trigger security (20) is activated.

The invention claimed is:

1. A modular grenade launcher for mounting beneath rifles, the modular grenade launcher comprising:

at least one barrel adapted to be loaded and unloaded on both sides thereof without moving said at least one barrel forward, said at least one barrel having a barrel mouth thrust at an end thereof;

a handle that opens axially at opposite sides after contacting the barrel mouth thrust, said handle having a handle channel positioned thereon;

a barrel joint cooperative with the handle channel so as to allow linear movement of said handle; and a double barrel lock cooperative with said handle such that a closing of said handle fixes a position of said at least one barrel during a firing of the modular grenade launcher.

2. The modular grenade launcher of claim 1, further comprising:

a handle metal sheet fixed on said at least one barrel so as to prevent axial rotation of said at least one barrel in said handle.

3. The modular grenade launcher of claim 1, further comprising:

a plurality of muzzle channels receiving said double barrel lock.

4. The modular grenade launcher of claim 1, further comprising:

a plurality of body channels cooperative with the handle channel and said barrel joint so as to prevent contact between said barrel joint and the handle channel after rotation of said at least one barrel.

5. The modular grenade launcher of claim 1, further comprising:

a striker cooperative with said at least one barrel and with said handle;

a striker security cooperative with said striker; and a striker security catch adapted to allow a firing of said striker security from a front of said striker when said handle is closed.

6. The modular grenade launcher of claim 5, further comprising:

a striker support adapted to cause said striker to hit upon a pin.

7. The modular grenade launcher of claim 1, further comprising:

a trigger movable between an active position and an inactive position; and a trigger security cooperative with said trigger so as to prevent said trigger from moving when moved to the active position.

* * * * *